US006481238B1

(12) United States Patent
Jennings et al.

(10) Patent No.: US 6,481,238 B1
(45) Date of Patent: Nov. 19, 2002

(54) KEG SERVER

(75) Inventors: Thomas A. Jennings; Stephen E. Bertrand, both of Winston-Salem, NC (US)

(73) Assignee: Cold-Sell Systems, L.L.C., Winston-Salem, NC (US)

( * ) Notice: Subject to any disclaimer, the term of this patent is extended or adjusted under 35 U.S.C. 154(b) by 0 days.

(21) Appl. No.: 09/928,826

(22) Filed: Aug. 13, 2001

(51) Int. Cl.[7] ..... F25D 3/08
(52) U.S. Cl. ..... 62/457.4; 62/371; 62/389
(58) Field of Search ..... 62/371, 384, 400, 62/457.1, 457.4, 530

(56) References Cited

U.S. PATENT DOCUMENTS

| | | | | | |
|---|---|---|---|---|---|
| 3,254,502 | A | | 6/1966 | Ellis | 62/257 |
| 3,491,548 | A | | 1/1970 | Christiansen | 62/255 |
| 3,790,032 | A | | 2/1974 | George | 222/146 |
| 4,164,853 | A | * | 8/1979 | McDonough | 62/457 |
| 4,225,059 | A | | 9/1980 | Kappos | 222/146 |
| 4,238,053 | A | | 12/1980 | Bonini | 222/129.1 |
| 4,319,629 | A | | 3/1982 | Hotta | 165/47 |
| 4,481,791 | A | * | 11/1984 | German | 62/400 |
| 4,633,678 | A | * | 1/1987 | Lea et al. | 62/457 |
| 4,651,538 | A | | 3/1987 | Bull et al. | 62/398 |
| 5,129,552 | A | | 7/1992 | Painchaud et al. | 222/146.6 |
| 5,251,790 | A | | 10/1993 | Cohn et al. | 222/146.6 |
| 5,282,561 | A | | 2/1994 | Mihalich | 222/146.6 |
| 5,339,986 | A | | 8/1994 | Mihalich | 222/1 |
| 5,405,012 | A | * | 4/1995 | Shindler et al. | 206/569 |
| 5,494,195 | A | | 2/1996 | Knuettel, II et al. | 222/146.6 |
| 5,564,602 | A | | 10/1996 | Cleland et al. | 222/146.6 |
| 5,584,188 | A | | 12/1996 | Tippmann et al. | 62/239 |
| 5,669,233 | A | | 9/1997 | Cook et al. | 62/371 |
| 5,934,100 | A | * | 8/1999 | Hornick | 62/457.4 |
| 5,953,931 | A | | 9/1999 | Brittain | 62/272 |
| 5,996,842 | A | | 12/1999 | Riley et al. | 222/1 |
| 6,010,043 | A | | 1/2000 | Williamson et al. | 222/608 |
| 6,067,810 | A | | 5/2000 | Jennings et al. | 62/246 |
| 6,073,547 | A | | 6/2000 | Westbrooks, Jr. et al. | 99/468 |
| 6,105,825 | A | | 8/2000 | Gomi et al. | 222/146.6 |

OTHER PUBLICATIONS

Kegclub.com; The Ice Block Keg Jacket for Beer & Soda Kegs; information from internet; copyright 2000.*
Kegclub.com; The Ice Block Keg Jackets for Beer & Soda Kegs; information from the internet; copyright 2000.
Kegworks.com; Keg Refrigerators; information from the internet; copyright 2000.
A Best Kitchen.com; Beer Dispenser, information from the internet, copyright 2000.
CompactAppliance.com; Portable Beer Dispenser/Kegerator; information from the internet; copyright 1999–2000.
Draft Equipment from KegWorld; Half–Keg Portable Draft Beer Tap, information from the internet, undated.
R U Ready 2 Party.com; Keg Coolers; information from the internet. undated.

* cited by examiner

*Primary Examiner*—Denise L. Esquivel
*Assistant Examiner*—Melvin Jones
(74) *Attorney, Agent, or Firm*—MacCord Mason PLLC

(57) ABSTRACT

An apparatus for serving a chilled beverage from a keg includes an insulated housing having two opposed side walls and a door hinged to one of the side walls. Support racks are spaced from one to permit fit a keg between the racks, which form slidable grooves for insertion and removal of chiller panels when the door is open. Casters on the housing permit mobility, and channels on the outside of the housing receive selectively replaceable graphic material. A spout on the housing connectable to a keg provides discharge of the keg contents. A pressurized gas canister connectable to a keg urges discharge of the keg contents through the spout. A plurality of chiller panels contain a freezable liquid and are adapted to be removeably mounted on the racks. The panels may be frozen in a freezer and loaded into the racks keep the keg and its contents cold.

42 Claims, 3 Drawing Sheets

KEG SERVER

BACKGROUND OF THE INVENTION

Establishments, organizations, or individuals that serve large volumes of beer to guests or customers find it most convenient and economical to serve beer from pressurized metal kegs. Half, quarter and one-eighth kegs of beer (hereinafter collectively referred to as "kegs") are widely available from distributors and retailers. Beer packaged in kegs can be purchased and dispensed at a fraction of the cost of canned or bottled beer. In addition, many people prefer the taste and experience of drinking draught beer served from a keg into a glass.

Beer is dispensed from these kegs by first pressurizing the keg with a manual air pump or by introducing pressurized $CO_2$ into the keg from a canister, and then drawing the beer from the keg through a spout. Various systems are well known in the art for dispensing beer from a keg in this manner.

Special electric refrigerators are commercially available for chilling and serving beer from kegs at a desired temperature. These so-called "kegerators" include an insulated enclosure sized to receive a of beer, an electric refrigeration unit, a $CO_2$ canister and regulator for pressurizing the keg, and a tap for drawing beer from the keg. These units also typically include an adjustable thermostat for regulating the temperature of the beer in the keg at a desired temperature. While these units are effective for serving beer from a keg at a desired temperature, they have several shortcomings. First, the electrical refrigeration equipment makes these units very heavy and difficult to move long distances or over rough terrain, even when casters are provided on the bases of the units. Second, these units require electricity, and their electrical cords must be plugged into an accessable outlet. Accordingly, if it is desired to serve beer outdoors such as on a golf course, the electrical keg server must be located near an outdoor electrical outlet. Alternatively, hazardous extension cords must be used. Therefore, if it is desired to serve beer from a keg at a location without an available source of electricity or that is distant from the closest available electrical outlet, these units are not preferable. Thus, there is a need for a keg server which does not require electricity or electrical cords, and is also highly portable.

Others have addressed this need by placing a pre-chilled keg in a tub of ice. While this popular approach reduces the portability problems associated with electric keg servers, the ice melts, causing problems of spillage, sanitation and other untoward effects. Emptying kegs have even been known to float on the meltwater. Others have developed more sophisticated keg servers that also employ bulk ice to chill a keg's contents. For example, U.S. Pat. No. 6,010,043 to Williamson et al. discloses a portable draw box for dispensing beer from one or two kegs in the draw box. The beer in the keg(s) is maintained at a chilled temperature by surrounding the base of the keg(s) with bulk ice in a first cooling well on the inside bottom of an enclosure containing the keg(s). The beer is additionally cooled when served by directing the beer drawn from the keg through a cold plate located in a second cooling well that is also packed with ice. The use of ice in this manner also introduces the need to deal with the melt-water from the ice.

Therefore, there is a need for a portable keg server that dispenses beer or another beverage from of a pre-chilled keg without ice or electricity.

SUMMARY OF THE INVENTION

The present invention meets this need by providing a keg server including an insulated enclosure including sidewalls, a top, and a bottom defining a volume within the enclosure, a dispensing spout outside of the enclosure and having a tap adapted for connection to a keg containing a beverage in the enclosure; and one or more removable chiller panels in the volume in the enclosure near one or more of the sidewalls, top, and bottom, so as to leave an air space in the volume between the keg and the chiller panels, so that the beverage is maintained at a temperature below an ambient temperature and greater than the freezing point of water.

The invention also provides an apparatus for serving a chilled beverage from a keg including an insulated housing having racks inside the housing spaced from one another sufficiently to permit a keg to be located in the housing between the racks, a spout on the housing adapted for connection to a keg in the housing to provide discharge of the keg contents through the spout, and a plurality of chiller panels containing a freezable liquid and adapted to be removeably mounted on the racks in the housing so that the panels may be frozen in a freezer and loaded into the racks on opposite sides of a keg in the housing to keep the keg and its contents cold.

In one embodiment the housing is mounted on casters to permit mobility of the apparatus. The housing may have an outside that includes channels to receive selectively replaceable graphic material. The housing may have a pressurized gas canister adapted for connection to a keg in the housing to urge discharge of the keg contents through the spout.

Preferably, the racks are far enough apart to avoid touching a keg in the housing to prevent over-chilling of the keg. The housing may include two opposed side walls and a door between the side walls, with the support racks mounted on the side walls to form slidable grooves exposed to permit insertion and removal of the chiller panels when the door is open. The racks may each include support for two thicknesses of chiller panels. The racks may be provided to provide upper and lower courses of chiller panels.

In one embodiment, the door is hinged to one of the side walls. Preferably, the door has magnetic seals to keep the door closed. A lock may also be provided to inhibit unauthorized access to the interior of the housing.

The invention also provides a method of serving a chilled beverage including freezing a plurality of chiller panels, loading the chiller panels horizontally into an insulated housing, loading a keg of beverage to be served into the housing between the chiller panels and connecting the keg to a discharge spout, closing the housing, and dispensing chilled beverage through the spout.

The method may include moving the housing with contained keg and chiller panels on casters. It may also include installing graphic material in channels on the outside of the housing. The method may include connecting a pressurized gas canister in the housing to the keg in the housing to urge discharge of the keg contents through the spout. The loading of the chiller panels may include sliding the panels on racks mounted on two opposed side walls in the housing when a door to the housing is open. Loading may also include loading two thicknesses of chiller panels on each sidewall. Loading may include loading upper and lower courses of chiller panels.

The invention also provides a method of dispensing beverages at an event venue including freezing a first plurality of chiller panels at a freezer, cooling a second plurality of beverage kegs, locating keg servers at locations at the event venue, delivering and installing cooled beverage kegs to the keg servers, delivering and installing frozen chiller panels to the keg servers, and dispensing beverage from the kegs at the respective keg servers located at locations of the event venue. The method may include replacing chiller panels in the keg servers with freshly frozen chiller panels.

In one advantageous embodiment the event venue is a golf course and the locations of the event venue are selected holes of the golf course. Delivering frozen chiller panels may include transporting the chiller panels on golf carts.

The invention also provides a method of distributing beverages including freezing a plurality of chiller panels at a freezer, cooling a beverage keg, delivering a cooled beverage keg and keg server to a consumer and charging the consumer for the delivered keg and keg server, permitting the consumer to dispense beverage from the keg at the keg server without ice or electricity, and retrieving the keg and keg server when the keg is depleted.

BRIEF DESCRIPTION OF THE DRAWINGS

The invention will be better understood by a reading of the Detailed Description of the Preferred Embodiments along with a review of the drawings, in which.

DETAILED DESCRIPTION OF THE PREFERRED EMBODIMENT

Figure 1:
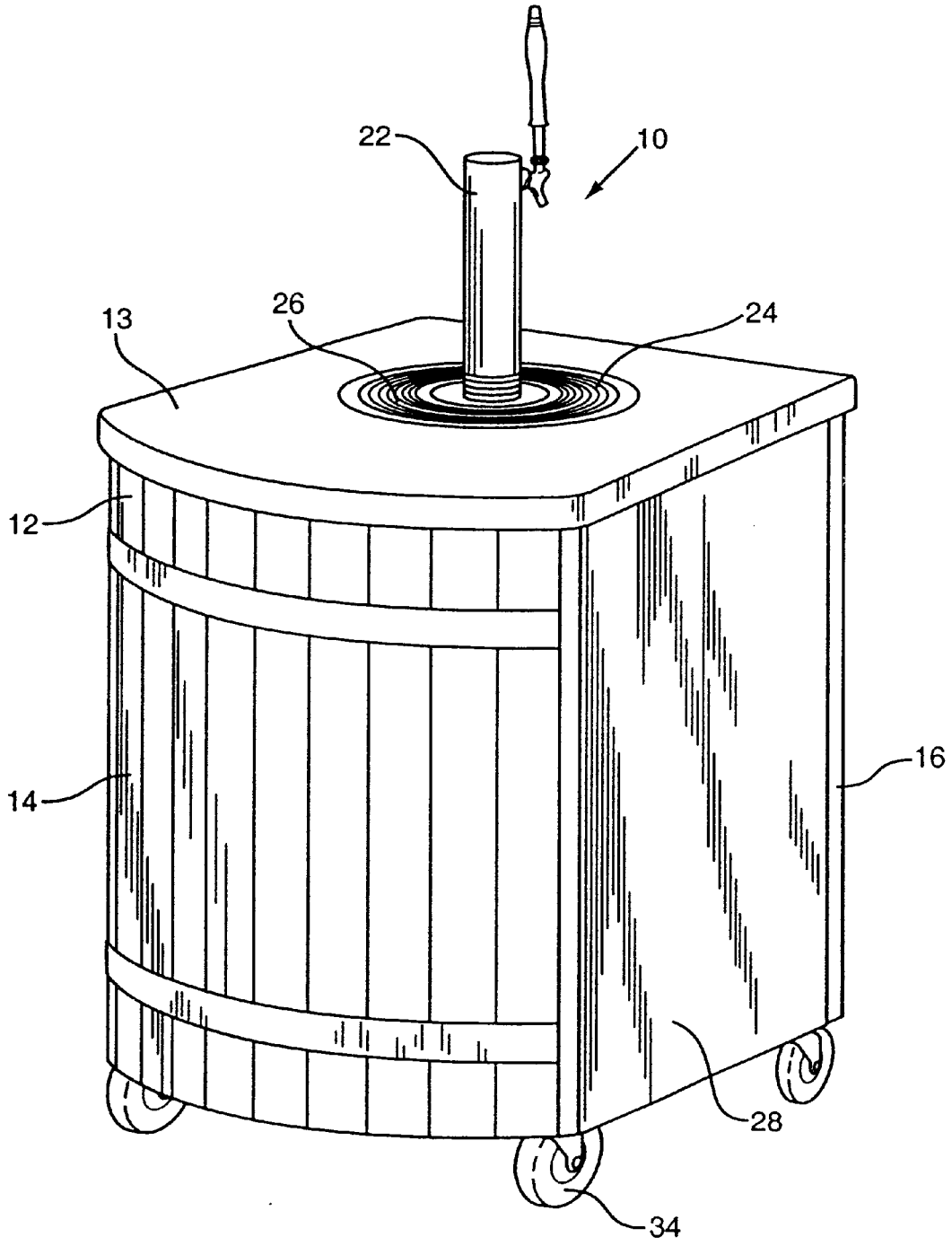
FIG. 1 is a perspective view of a keg server in accordance with an embodiment of the invention.

An improved keg server according to the preferred embodiment of the invention is shown in FIG. 1. This includes a housing 12 made up of an end wall and two side walls 16 and 18. Side wall 18 and door 20 are not visible in FIG. 1, but are visible in FIGS. 2 and 6, respectively. The exterior of the housing, such as for example side 16 is provided with replaceable graphics 28. The technique of installation can be as described in our co-pending application Ser. No. 09/755,938, filed Jan. 5, 2001 entitled Improved Point of Sale Product Chiller. Other similar installation methods can be substituted. The replaceable graphics is not essential but it adds to the usefulness of the keg server when promoting the sale of a product from the keg in the server, such as sporting events or other events. By making the graphics replaceable, they may be made to correspond to the contents of the keg. Should the brand of beverage in the keg vary from one keg to another, the graphics can be made to correspond.

Figure 3:
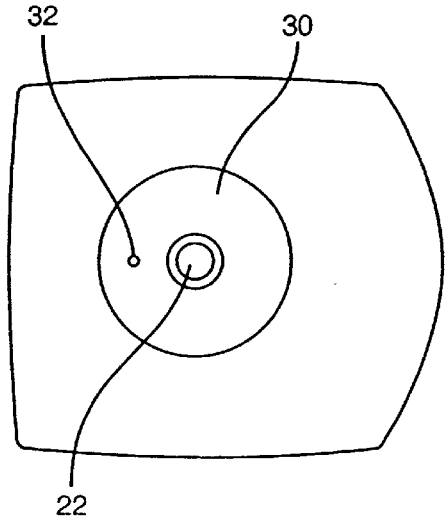
FIG. 3 is a top schematic exterior view of the embodiment of FIG. 1.

As can be seen, housing 12 has a top 13 on which is mounted a spout 22. Surrounding the spout is a basin 30 covered by two grate halves 24 and 27. The grates permit any spilled beverage to drain into the basin for connection to a waste collection container within the housing 12. FIG. 3 shows the top view of the apparatus with the grate halves 24 and 27 removed, exposing the basin 30 and drain line 32.

Figure 2:
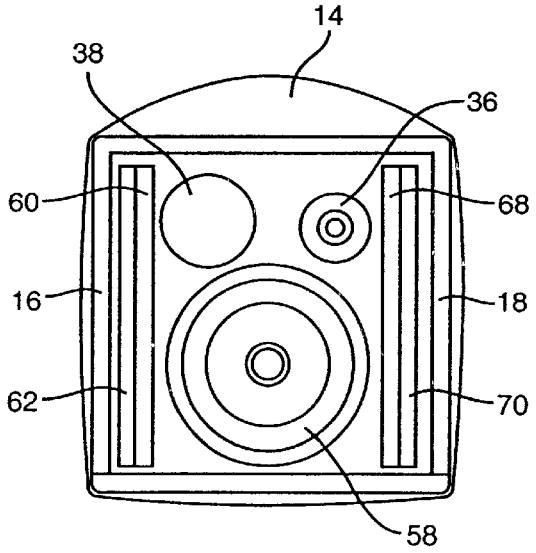
FIG. 2 is a top schematic interior view of the embodiment of FIG. 1.

FIG. 2 shows schematically located within the housing 12, the keg 58, a pressurized gas source such as a carbon dioxide cylinder 36 and a waste container 38. Also visible in FIG. 2 are chiller panels 60, 62, 68 and 70, the mounting of which will be described in connection with FIG. 4.

Figure 4:
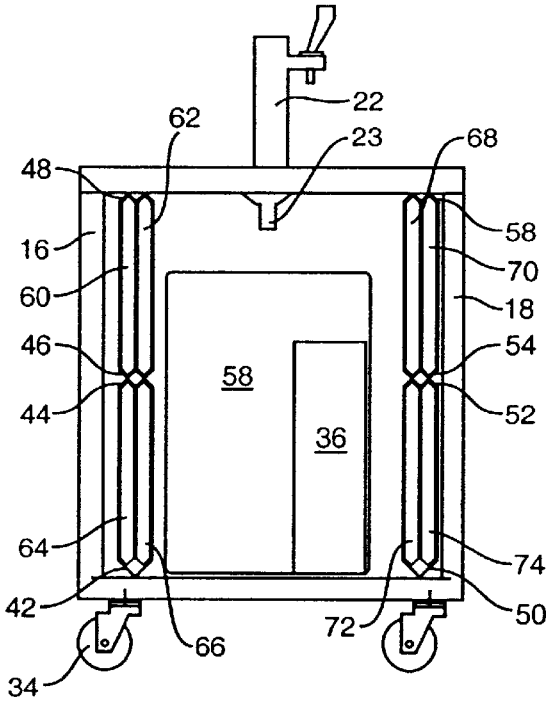
FIG. 4 is a rear schematic interior view of the embodiment of FIG. 1.

FIG. 4 shows an interior view of the apparatus, with the door 20 open. A magnetic seal 25 adjacent the opening to the interior of the apparatus help keep the door closed and prevent air leaks. A lock (not shown) can be provided to prevent unauthorized entry to the interior of the apparatus.

Figure 5:
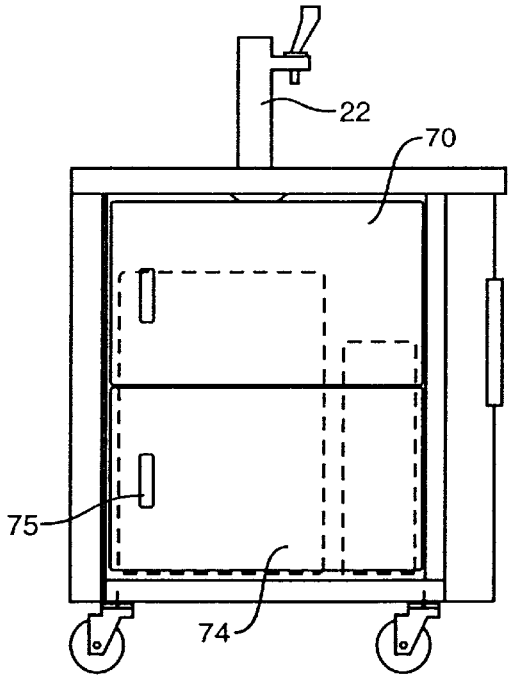
FIG. 5 is a side schematic interior view of the embodiment of FIG. 1.

As can be seen, the spout 22 has a tap connection line 23 adapted for fitting to the keg 58. Mounted to the inside of walls 14 and 16 are brackets or racks 42, 44, 46 and 48. The rack 42 provides a trough or groove facing upwardly and extending the width of wall 16. The rack 44 provides a downwardly opening tough in opposition to the trough of rack 42. The rack 44 is spaced from the rack 42 a distance slightly larger than the width of the chiller panels 64, 66, so that the chiller panels can be located between the racks by sliding with the panel edges received in the respective upper and lower troughs and thereby be held in position. As can be seen, two such chiller panels 64 and 66 can be provided to provide substantial chilling capacity within the housing 14. The panels 64 and 66 are preferably of the construction described in my co-pending application serial number application Ser. No. 09/755,938, filed Jan. 5, 2001 entitled Improved Point of Sale Product Chiller. The entire disclosure of that application is hereby incorporated by reference. As can be seen in FIG. 5, the panels preferably have cut out holes such as hole 75 to provide easy carrying of the panels. While the racks are shown mounted to the walls, they can also be independently supported, spaced from the walls.

Above the rack 44 are two additional racks 46 and 48 of similar configuration and spacing to the racks 42 and 44 to hold an upper course of chiller panels of 60 and 62. Similarly, racks 50 and 52 are attached to side wall 18 are sized and positioned to hold a lower course of chiller panels 72 and 74. Racks 54 and 56 are similarly sized and positioned to hold an upper course of chiller panels 68 and 70. Preferably all of the chiller panels 60, 62, 64, 66, 68, 70, 72, and 74 are identical so that their placement and replacement in the housing is uncomplicated as possible. However, if differing sizes of housings are desired, alternate panel sizings can be substituted along with appropriate variations in the placement of the support racks.

Figure 6:
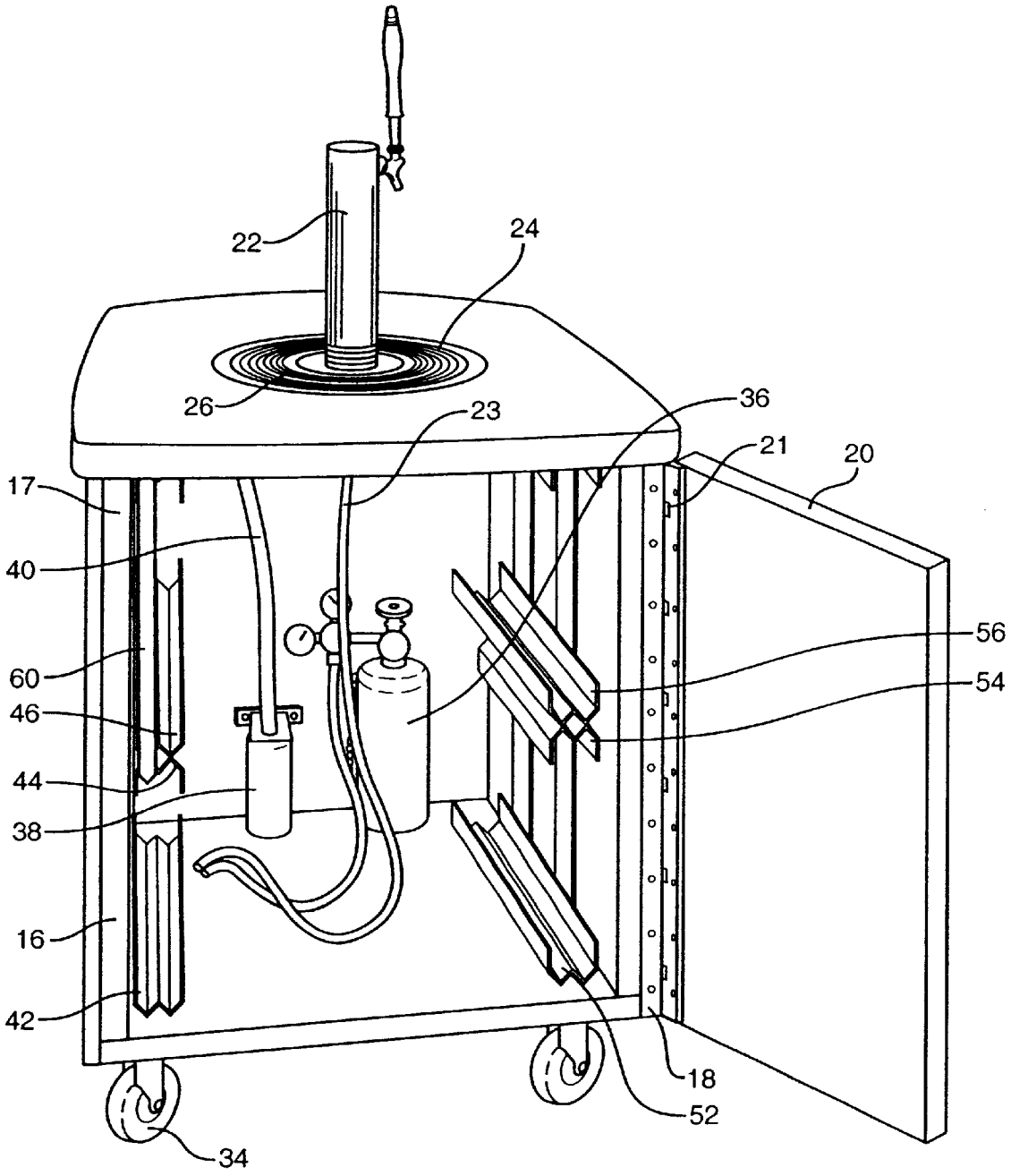
FIG. 6 is a perspective view of the interior of the embodiment of FIG. 1.

As seen in FIG. 6, the sidewall 16 has substantial thickness 17 and is made of a suitable material to provide structural support and thermal insulation to retard the ingress of heat from the ambient into the housing, thereby assuring that the chiller panels will maintain the contents of the keg 58 cold. As seen in FIG. 6, the door 20 is mounted by hinge 21 outwardly of the side wall 18 so that when open, the door does not obstruct the interior of the housing and does not interfere with loading and unloading of chiller panels into the rack. As seen in FIG. 6, the carbon dioxide canister 36 can be provided with suitable gauges and valves in conventional fashion to permit adjustment to achieve a desired pressure level in the keg. The canister 36 is preferably constrained from movement within the housing by a safety retainer 37.

The waste drain 38 is provided as a canister which receives spillage from drain line 32 connected to a drain in basin 30 and which can be removed and dumped when nearing full.

In operation, a keg of a beverage is chilled to a desired temperature and loaded into the housing 12. The carbon dioxide canister 36 is connected as is conventional to pressurize the keg. The tap connection line 23 from the spout 22 is connected to the keg to permit discharge of beverage from the keg through the spout 22. Spillage in proximity to the spout is collected through the grate halves 24 and 26 drains through the basin 30 and the drain line 32 into the waste drain 38.

The chiller panels are frozen, preferably in a freezer that creates a temperature of minus 20 to minus 30 degrees Fahrenheit to insure proper complete freezing of the panels. Once they are completely frozen, the panels are loaded into the respective racks on the side walls. The door 20 is then closed and beverage dispensing may proceed. Alternatively, the panels can be installed prior to the loading of the keg. The chiller panel should be replaced after 24 hours with similarly chilled chiller panels to maintain proper product temperatures. Using these procedures, the apparatus will maintain a beverage in a keg within the unit and at a temperature in the upper 30 degree Fahrenheit range for up to twenty-eight hours.

The housing is preferably sized to receive a half keg, quarter keg, or eighth keg. As can be appreciated, smaller units can be installed in larger servers. Alternatively, the apparatus can be of a size to handle another suitable size.

One of the advantages of the preferred embodiment of the invention is that the housing 12 is large enough to keep the keg out of direct contact with the chiller panels. This keeps the chiller panels from chilling the keg to an excessively low temperature. In certain embodiments the keg temperature is maintained at between about 35 degrees Fahrenheit and about 45 degrees Fahrenheit, and more preferably about 40 degrees Fahrenheit, for a preferred beer temperature.

If the ambient temperature is low to begin with or it is not preferred to keep the beverage in a keg of excessively cold temperature, then less than all of the chiller panels could be used.

The invention is quite versatile and enables the dispensing of chilled beverages in areas where ice and or electricity are not available. In particular, for an event such as a golf tournament where beer may be desired to be sold far from a clubhouse, the apparatus can be located in the desired location. For example, it may be desirable to have a beer keg server at each of various holes along a golf course to enable the dispensing and sale of beer to spectators of a golf tournament. Chilled beer kegs can be loaded into the servers, and frozen panels can be transported (such as by golf cart) to the locations of the servers and installed in the server housings, as indicated above. This eliminates the any need for supplying electricity or ice to the unit and eliminates the need to deal with the melt water of ice which in prior art devices would be used to keep the beer cold.

The apparatus can also be used in numerous other venues. It can be particularly useful at places where electricity is not available or may be unsafe, such as at swimming pools or other bodies of water.

In addition, a novel method of doing business can be carried out. Consumers who order a keg of beer from a distributor, can also rent an apparatus as described for the dispensing of the beer. The distributor can deliver the keg and apparatus, selling the beer and renting the apparatus. When the keg is depleted the empty keg and apparatus can be picked up by the distributor. This business model should be construed to include offering the apparatus free to customers for use with a purchased keg.

While the apparatus will often be used to dispense beer, other beverages can, of course, be dispensed, as desired. Various other modifications that will be apparent to those of ordinary skill in the art may also be accommodated and still be within the scope of the invention.

What is claimed is:

1. A keg server comprising:

an insulated enclosure including sidewalls, a top, and a bottom;

a dispensing spout connected to a keg containing a beverage in the enclosure; and at least one removable chiller panel in the enclosure;

wherein the chiller panel in the enclosure is separated from the keg by an air space, and wherein the chiller panel is sufficiently distant from the keg so that the beverage is maintained at a temperature greater than the freezing point of water.

2. The apparatus of claim 1 wherein the keg server maintains the beverage temperature between about 35 degrees Fahrenheit and about 45 degrees Fahrenheit.

3. The apparatus of claim 2 wherein the keg server maintains the beverage temperature at about 40 degrees Fahrenheit.

4. The apparatus of claim 1 further including an access door on the enclosure.

5. The apparatus of claim 4 wherein the door has magnetic seals to keep the door closed.

6. The apparatus of claim 4 wherein the door has a lock to inhibit unauthorized access to the interior of the enclosure.

7. The apparatus of claim 1 further including casters on the bottom of the enclosure.

8. The apparatus of claim 1 further including a dispensing tower having a lower end an upper end wherein the dispensing spout is mounted on the dispensing tower at or near its upper end.

9. The apparatus of claim 8 further including a spill basin in the top of the enclosure.

10. The apparatus of claim 9 wherein the spill basin surrounds the dispensing tower.

11. The apparatus of claim 9 further including;

a drain in the spill basin;

a spillage receptacle in the enclosure; and a drain tube connecting the drain to the spillage receptacle.

12. The apparatus of claim 9 further comprising a grate in the spill basin.

13. The apparatus of claim 10 wherein the grate includes two or more removable grate segments.

14. A keg server comprising:

an insulated enclosure including sidewalls, a top, and a bottom defining a volume within the enclosure;

a dispensing spout outside of the enclosure and having a tap adapted for connection to a keg containing a beverage in the enclosure; and one or more removable chiller panels in the volume in the enclosure near one or more of the sidewalls, top, and bottom, so as to leave an air space in the volume between the keg and the chiller panels, so that the beverage is maintained at a temperature below an ambient temperature and greater than the freezing point of water.

15. An apparatus for serving a chilled beverage from a keg comprising an insulated housing having racks inside the housing spaced from one another sufficiently to permit a keg to be located in the housing between the racks, a spout on the housing adapted for connection to a keg in the housing to provide discharge of the keg contents through the spout, and a plurality of chiller panels containing a freezable liquid and adapted to be removeably mounted on the racks in the housing so that the panels may be frozen in a freezer and loaded into the racks on opposite sides of a keg in the housing to keep the keg and its contents cold.

16. An apparatus as claimed in claim 15 wherein the housing is mounted on casters to permit mobility of the apparatus.

17. An apparatus as claimed in claim 15 wherein the housing has an outside, and the outside includes a channel to receive selectively replaceable graphic material.

18. An apparatus as claimed in claim 15 further comprising a pressurized gas canister in the housing adapted for connection to a keg in the housing to urge discharge of the keg contents through the spout.

19. An apparatus as claimed in claim 15 wherein the racks are far enough apart to avoid touching a keg in the housing to prevent over-chilling of the keg.

20. An apparatus as claimed in claim 15 wherein the housing includes two opposed side walls and a door between the side walls, and the support racks are mounted on the side walls and form slidable grooves exposed to permit insertion and removal of the chiller panels when the door is open.

21. An apparatus as claimed in claim 20 wherein the racks each include support for two thicknesses of chiller panels.

22. An apparatus as claimed in claim 20 wherein the door is hinged to one of the side walls.

23. An apparatus as claimed in claim 20 wherein the racks are provided to provide upper and lower courses of chiller panels.

24. The apparatus of claim 20 wherein the door has magnetic seals to keep the door closed.

25. The apparatus of claim 20 wherein the door has a lock to inhibit unauthorized access to the interior of the enclosure.

26. An apparatus for serving a chilled beverage from a keg comprising an insulated housing having two opposed side walls and a door hinged to one of the side walls, and support racks mounted on the side walls spaced from one another sufficiently to permit a keg to be located in the housing between the racks, the racks forming slidable grooves exposed to permit insertion and removal of chiller panels when the door is open, the housing being mounted on casters to permit mobility of the apparatus and having an outside with channels to receive selectively replaceable graphic material, a spout on the housing adapted for connection to a keg in the housing to provide discharge of the keg contents through the spout, a pressurized gas canister in the housing adapted for connection to a keg in the housing to urge discharge of the keg contents through the spout, and a plurality of chiller panels containing a freezable liquid and adapted to be removeably mounted on the racks in the housing so that the panels may be frozen in a freezer and loaded into the racks on opposite sides of a keg in the housing to keep the keg and its contents cold, the racks being far enough apart to avoid touching a keg in the housing to prevent over-chilling of the keg.

27. An apparatus as claimed in claim 26 wherein the racks each include support for two thicknesses of chiller panels.

28. An apparatus as claimed in claim 26 wherein the racks provide upper and lower courses of chiller panels.

29. A method of serving a chilled beverage comprising:

freezing a plurality of chiller panels, loading the chiller panels horizontally into an insulated housing, loading a keg of beverage to be served into the housing between the chiller panels and connecting the keg to a discharge spout, closing the housing, and dispensing chilled beverage through the spout.

30. A method as claimed in claim 29 further comprising moving the housing with contained keg and chiller panels on casters.

31. A method as claimed in claim 29 further comprising installing graphic material in channels on the outside of the housing.

32. A method as claimed in claim 29 further comprising connecting a pressurized gas canister in the housing to the keg in the housing to urge discharge of the keg contents through the spout.

33. A method as claimed in claim 29 wherein loading the chiller panels includes sliding the panels on racks mounted on two opposed side walls in the housing when a door to the housing is open.

34. A method as claimed in claim 33 wherein loading includes loading two thicknesses of chiller panels on each sidewall.

35. A method as claimed in claim 33 wherein loading includes loading upper and lower courses of chiller panels.

36. A method of serving a chilled beverage comprising:

installing graphic material in channels on the outside of an insulated housing, freezing a plurality of chiller panels, sliding two thicknesses of chiller panels horizontally on racks mounted on two opposed side walls in the housing when a door to the housing is open, loading a keg of beverage to be served into the housing between the chiller panels, connecting the keg to a discharge spout, connecting a pressurized gas canister in the housing to the keg to urge discharge of the keg contents through the spout, closing the housing, dispensing chilled beverage through the spout, moving the housing with contained keg and chiller panels on casters.

37. A method as claimed in claim 36 wherein loading includes loading upper and lower courses of chiller panels.

38. A method of dispensing beverages at an event venue without ice or electricity comprising:

freezing a plurality of chiller panels at a freezer, cooling a plurality of beverage kegs, locating keg servers at locations at the event venue, delivering and installing cooled beverage kegs to the keg servers, delivering and installing frozen chiller panels to the keg servers, and dispensing beverage from the kegs at the respective keg servers located at locations of the event venue without ice or electricity.

39. A method as claimed in claim 38 further comprising replacing chiller panels in the keg servers with freshly frozen chiller panels.

40. A method as claimed in claim 38 wherein the event venue is a golf course and the locations of the event venue include selected holes of the golf course.

41. A method as claimed in claim 38 wherein delivering frozen chiller panels includes transporting the chiller panels on golf carts.

42. A method of distributing beverages comprising:

freezing a plurality of chiller panels at a freezer, cooling a beverage keg, delivering a cooled beverage keg and keg server to a consumer and charging the consumer for the delivered keg and keg server, permitting the consumer to dispense beverage from the keg at the keg server without ice or electricity, and retrieving the keg and keg server when the keg is depleted.

* * * * *